US007131354B1

(12) United States Patent
Huang

(10) Patent No.: US 7,131,354 B1
(45) Date of Patent: Nov. 7, 2006

(54) SPANNER

(76) Inventor: Chiu-Ta Huang, No. 31, Lane 18, Le-Chung St., Pei-Tun Dist., Taichung City (TW)

( * ) Notice: Subject to any disclaimer, the term of this patent is extended or adjusted under 35 U.S.C. 154(b) by 0 days.

(21) Appl. No.: 11/335,336

(22) Filed: Jan. 19, 2006

(51) Int. Cl.
*B25B 13/28* (2006.01)

(52) U.S. Cl. ..... 81/90.1; 81/90.9; 81/91.3; 81/91.2

(58) Field of Classification Search ..... 81/90.1, 81/90.9, 91.3, 91.2
See application file for complete search history.

(56) References Cited

U.S. PATENT DOCUMENTS 3,044,335 A * 7/1962 Keranen ..... 81/90.1
3,921,474 A * 11/1975 Dyck et al. ..... 81/91.2
6,286,398 B1 * 9/2001 Huang ..... 81/90.1

* cited by examiner

*Primary Examiner*—Joseph J. Hail, III
*Assistant Examiner*—Shantese L. McDonald
(74) *Attorney, Agent, or Firm*—Merchant & Gould P.C.

(57) ABSTRACT

A spanner includes an upper jaw, a handle, a lower jaw, and a resilient member. The upper jaw includes an upper jaw portion, and a pivot portion, and has a front pivot hole and a rear pivot hole both of which extend through the pivot portion. The handle has a connection end extending into the pivot portion and pivoted to the upper jaw at the rear pivot hole. The lower jaw has a lower jaw portion, a tail portion, and an insert part projecting into the pivot portion of the upper jaw. The insert part is pivoted to the upper jaw at the front pivot hole. The resilient member is disposed between the tail portion and the connection end to bias the tail portion away from the connection end so that the lower jaw portion is biased toward the upper jaw portion.

7 Claims, 7 Drawing Sheets

SPANNER

BACKGROUND OF THE INVENTION

1. Field of the Invention

The invention relates to a spanner, more particularly to a spanner which can be operated easily and efficiently.

2. Description of the Related Art

Referring to FIG. 1, a conventional spanner 10 is formed integrally, and includes two jaw units 12 spaced apart from each other, and a handle 11 interconnecting the jaw units 12. Each of the jaw units 12 includes an upper jaw portion 121 and a lower jaw portion 122 to define a receiving space 123 for a head 103 of a bolt 100. The upper and lower jaw portions 121, 122 of the spanner 10 abut against two parallel sides 101 of the head 103 of the bolt 100 for driving rotation of the bolt 100. Since the upper and lower jaw portions 121, 122 of each of the jaw units 12 is integrated with the handle 11, the receiving space 123 is not adjustable. Therefore, the conventional spanner 10 is relatively inconvenient to use and the flexibility thereof is limited, which in turn affects adversely work efficiency.

SUMMARY OF THE INVENTION

Therefore, the object of the present invention is to provide a spanner which can overcome the aforesaid shortcomings of the prior art.

The spanner according to this invention includes an upper jaw, a handle, a lower jaw, and a resilient member. The upper jaw includes an upper jaw portion, and a pivot portion extending rearwardly of the upper jaw portion, and has a front pivot hole and a rear pivot hole both of which extend through the pivot portion. The front pivot hole is disposed between the upper jaw portion and the rear pivot hole. The handle has a connection end extending into the pivot portion and connected pivotally to the upper jaw at the rear pivot hole. The lower jaw has a lower jaw portion spaced apart from the upper jaw portion, a tail portion opposite to the lower jaw portion and extending toward the connection end of the handle, and an insert part disposed between the lower jaw portion and the tail portion and projecting into the pivot portion of the upper jaw. The insert part is connected pivotally to the upper jaw at the front pivot hole. The resilient member is disposed between the tail portion and the connection end to bias the tail portion away from the connection end so that the lower jaw portion is biased toward the upper jaw portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
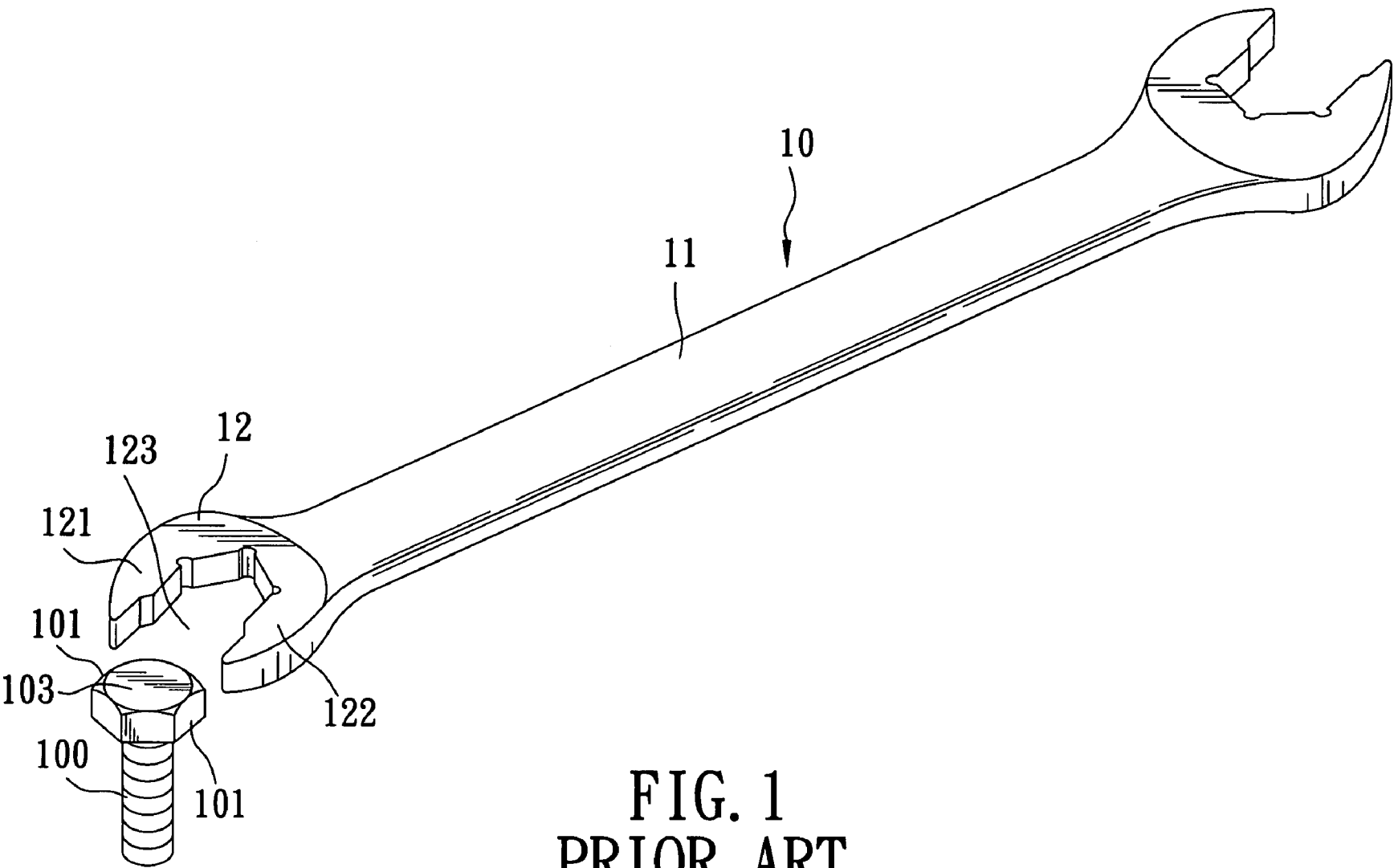
FIG. 1 PRIOR ART
FIG. 1 is a perspective view of a conventional spanner.
Figure 2:
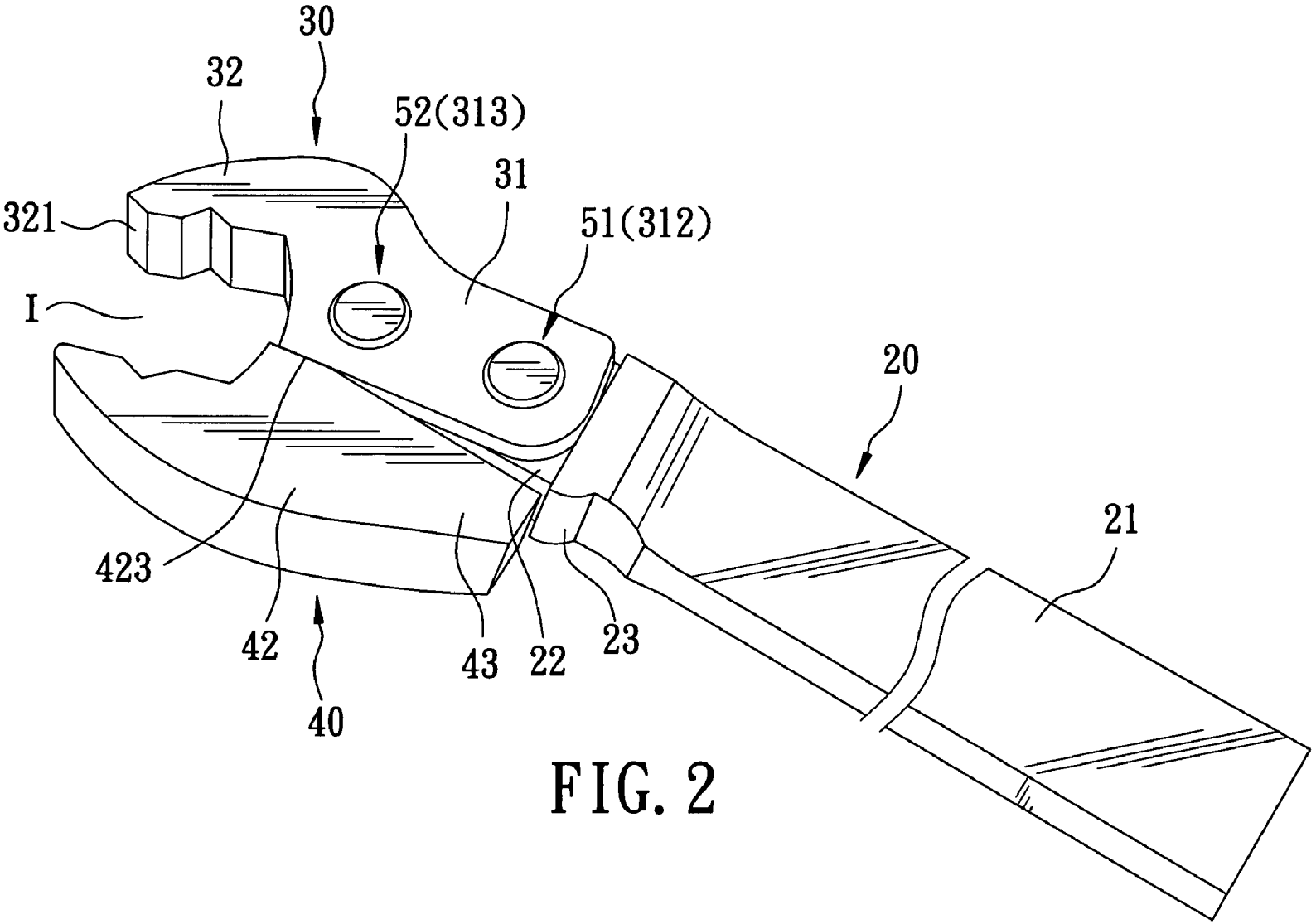
FIG. 2 is a fragmentary perspective view of a preferred embodiment of a spanner according to this invention.
Figure 3:
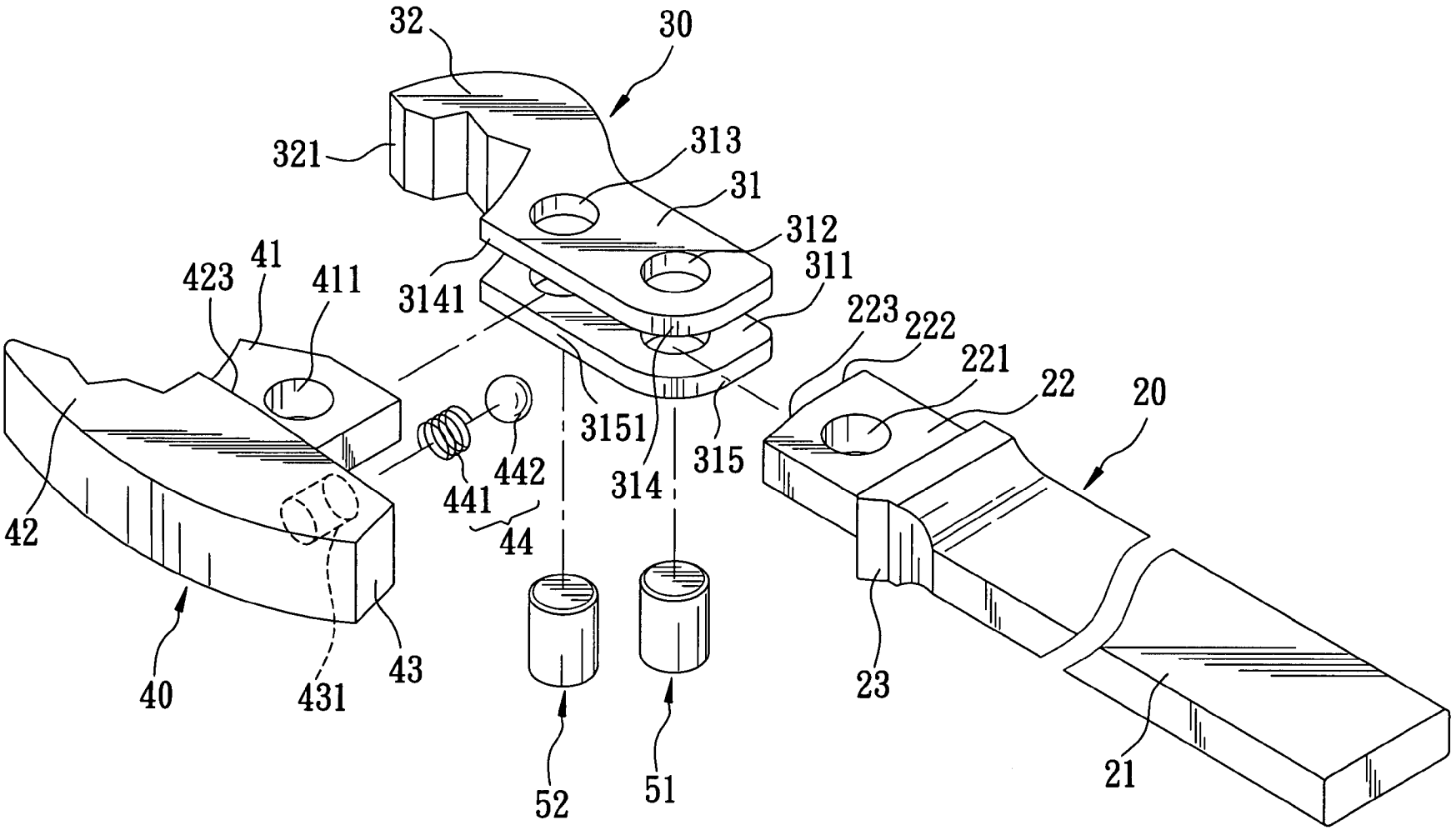
FIG. 3 is an exploded fragmentary perspective view of the preferred embodiment.
Figure 4:
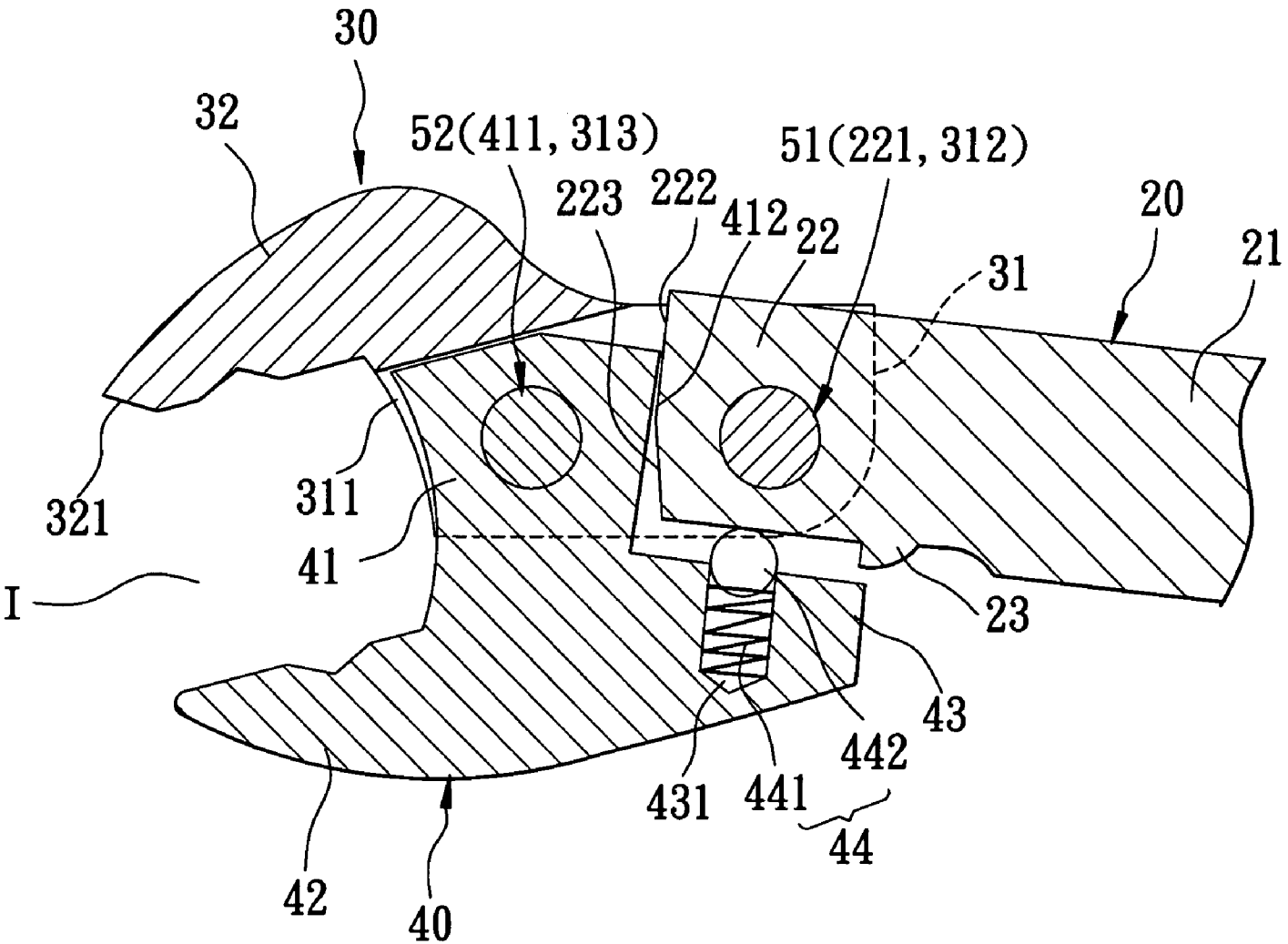
FIG. 4 is a fragmentary sectional view of the preferred embodiment.

Referring to FIGS. 2, 3, and 4, the preferred embodiment of a spanner according to this invention is shown to include an upper jaw 30, a handle 20, a lower jaw 40, and a resilient member 44.

The upper jaw 30 includes an upper jaw portion 32, and a pivot portion 31 extending rearwardly of the upper jaw portion 32, and has a front pivot hole 313 and a rear pivot hole 312, both of which extend through the pivot portion 31. The front pivot hole 313 is disposed between the upper jaw portion 32 and the rear pivot hole 312. The pivot portion 310 of the upper jaw 30 is bifurcated to form first and second plate portions 314, 315, which define a receiving space 311 therebetween. The first and second plate portions 314, 315 have lower end faces 3141, 3151, respectively. Each of the front and rear pivot holes 313, 312 extends through the first and second plate portions 314, 315. The upper jaw portion 32 of the upper jaw 30 has a sloped guide edge 321 adjacent to a frontmost end of the upper jaw portion 32.

The handle 20 has an elongate handling portion 21, and a connection end 22 extending into the receiving space 311 of the pivot portion 31 of the upper jaw 30 and connected pivotally to the upper jaw 30 at the rear pivot hole 312. The connection end 22 of the handle 20 has a push portion 23 posterior to the rear pivot hole 312, a pivot hole 221 extending through the connection end 22, and a front end face 222 having a beveled face 223 proximate to the lower jaw 40. The connection end 22 of the handle 20 is connected pivotally to the pivot portion 31 of the upper jaw 30 using a first pivot pin 51 that penetrates through the rear pivot hole 312 of the pivot portion 31 of the upper jaw 30 and the pivot hole 221 of the connection end 22 of the handle 20.

The lower jaw 40 has a lower jaw portion 42 spaced apart from the upper jaw portion 32 of the upper jaw 30 so as to define a clamping space (I), a tail portion 43 opposite to the lower jaw portion 42 and extending toward the connection end 22 of the handle 20, and an insert part 41 disposed between the lower jaw portion 42 and the tail portion 43 and projecting into the receiving space 311 of the pivot portion 31 of the upper jaw 30. The insert part 41 has a pivot hole 411 extending therethrough. The insert part 41 is connected pivotally to the pivot portion 31 of the upper jaw 30 using a second pivot pin 52 that penetrates through the pivot hole 411 of the insert part 41 and the front pivot hole 313. The push portion 23 of the handle 20 projects from the connection end 22 of the handle 20 to the tail portion 43 of the lower jaw 40. The tail portion 43 of the lower jaw 40 can be pushed by the push portion 23 of the handle 20 so as to move the lower jaw portion 42 toward the upper jaw portion 32 when the handle 20 is turned to an operative position, in which the handle 20 tightens a nut within the clamping space (I).

Furthermore, the front end face 222 of the connection end 22 of the handle 20 is capable of abutting against the insert part 41 of the lower jaw 40. The beveled face 223 of the front end face 222 is proximate to the lower jaw 40 for preventing the connection end 22 of the handle 20 from interfering with the insert part 41 of the lower jaw 40 when the handle 20 is turned clockwise. The lower jaw 40 has a shoulder face 423, which is proximate to the insert part 41 and which is capable of abutting against the lower end faces 3141, 3151 of the first and second plate portions 314, 315 of the pivot portion 31 of the upper jaw 30. The shoulder face 423 is beveled so as to prevent the lower jaw portion 42 of the lower jaw 40 from interfering with the pivot portion 31 of the upper jaw 30 when the handle 20 is turned clockwise.

The resilient member 44 is disposed between the tail portion 43 of the lower jaw 40 and the connection end 22 of the handle 20 to bias the tail portion 43 away from the connection end 22 so that the lower jaw portion 42 is biased toward the upper jaw portion 32. The tail portion 43 of the lower jaw 40 has a recess 431. The resilient member 44 includes a spring 441 received in the recess 431, and a ball 442 received in the recess 431 and biased by the spring 441 to move outward and contact the connection end 22 of the handle 20.

Figure 5:
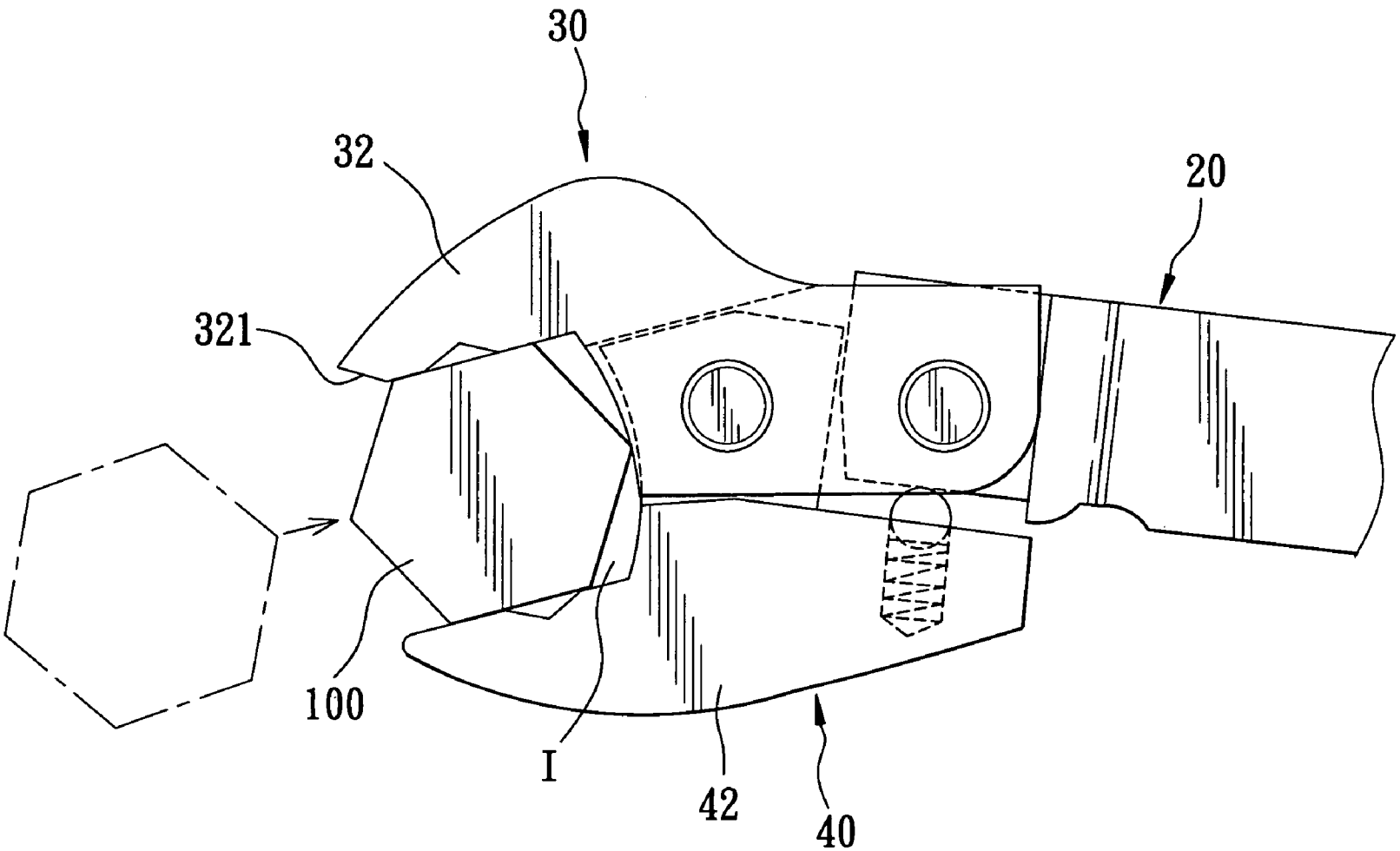
FIGS. 5, 6, and 7 are fragmentary schematic views showing operation of the preferred embodiment.

Referring to FIG. 5, when using the spanner to drive rotation of a bolt 100, the bolt 100 is guided easily by the sloped guide edge 321 of the upper jaw 30 into the clamping space (I).

Figure 6:
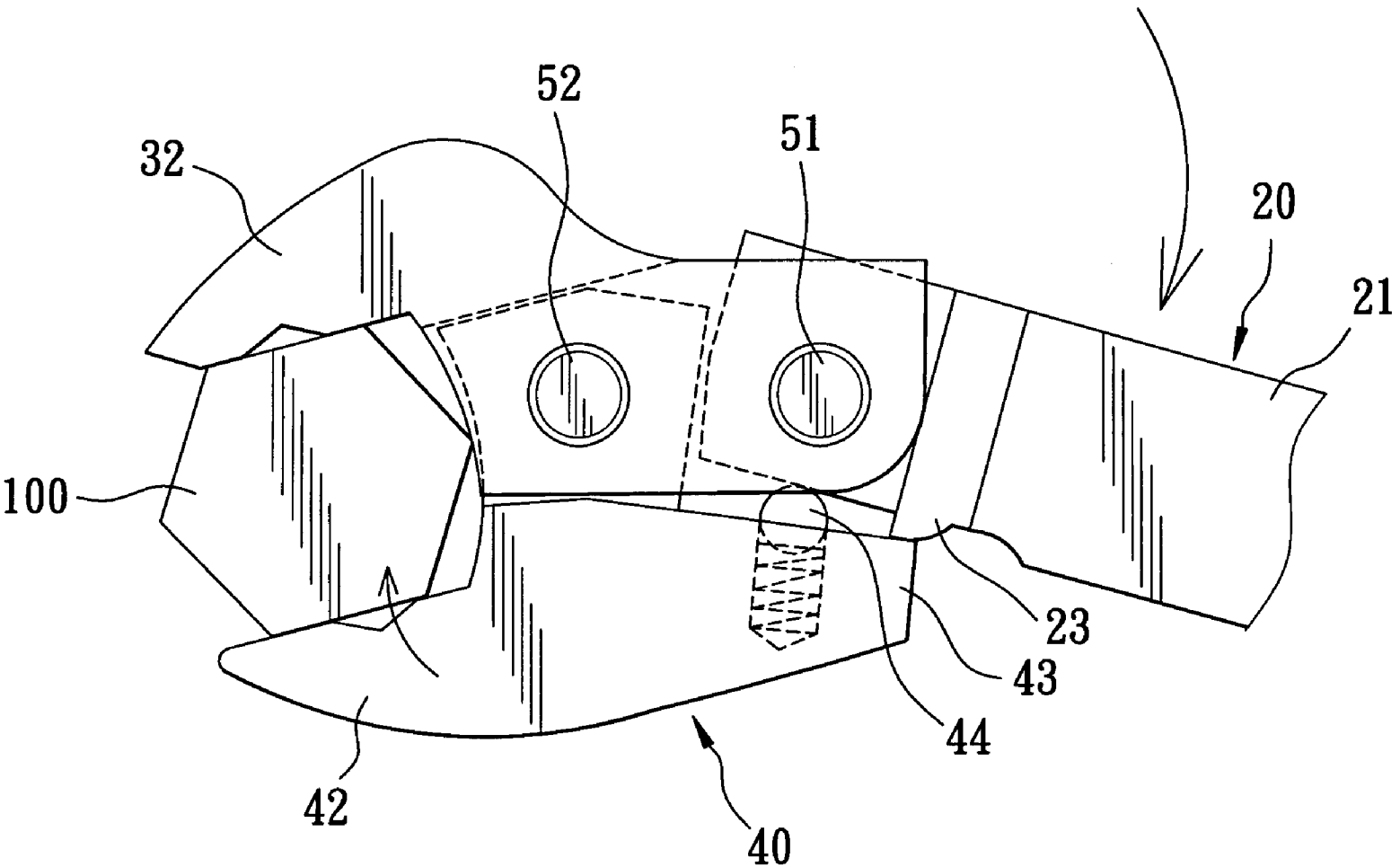

Referring to FIG. 6, when the handle 20 is turned clockwise, the handle 20 is pivoted about the first pivot pin 51 so as to enable the push portion 23 to push the tail portion 43 of the lower jaw 40. The lower jaw 40 pivots clockwise about the second pivot pin 52 so as to clamp the bolt 100 between the upper and lower jaws 30, 40. The handle 20 is then turned clockwise further to drive rotation of the bolt 100.

Figure 7:
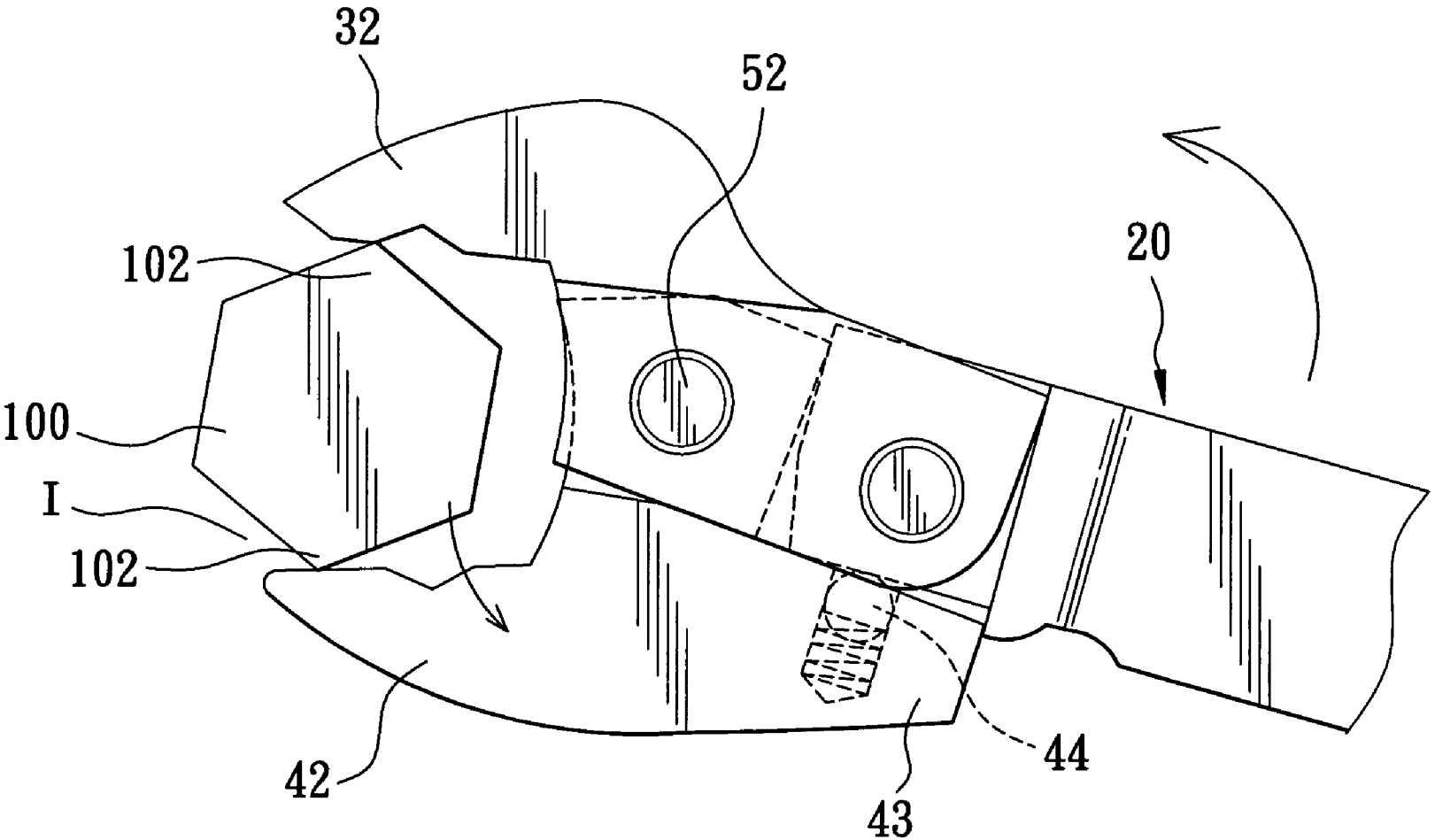

Referring to FIG. 7, when the handle 20 is turned to a position in which the handle 20 cannot be turned clockwise further, the handle 20 is turned counterclockwise. The lower jaw portion 42 of the lower jaw 40 can be turned away from the upper jaw portion 32 of the upper jaw 30, and the tail portion 43 of the lower jaw 40 moves toward the connection end 22 of the handle 20 to compress the resilient member 44. At the same time, the bolt 100 is maintained in contact with the upper and lower jaw portions 32, 42. After the upper and lower jaw portions 32, 42 of the upper and lower jaws 30, 40 cross two opposite corners 102 to reach a state shown in FIG. 6, the handle 20 can be further turned clockwise to continue the bolt driving operation.

In view of the aforesaid, the spanner of this invention can be used to drive rotation of the bolt 100 without removal of the spanner from the bolt 100, thereby improving work efficiency.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A spanner comprising:

an upper jaw including an upper jaw portion, and a pivot portion extending rearwardly of said upper jaw portion, and having a front pivot hole and a rear pivot hole both of which extend through said pivot portion, said front pivot hole being disposed between said upper jaw portion and said rear pivot hole;

a handle having a connection end extending into said pivot portion and connected pivotally to said upper jaw at said rear pivot hole;

a lower jaw having a lower jaw portion spaced apart from said upper jaw portion, a tail portion opposite to said lower jaw portion and extending toward said connection end of said handle, and an insert part disposed between said lower jaw portion and said tail portion and projecting into said pivot portion of said upper jaw, said insert part being connected pivotally to said upper jaw at said front pivot hole; and a resilient member disposed between said tail portion and said connection end to bias said tail portion away from said connection end so that said lower jaw portion is biased toward said upper jaw portion, wherein said pivot portion of said upper jaw is bifurcated to form first and second plate portions, each of said front and rear pivot holes extending through said first and second plate portions, said connection end and said insert part extending between said first and second plate portions.

2. The spanner as claimed in claim 1, wherein said connection end of said handle has a push portion posterior to said rear pivot hole to push said tail portion so as to move said lower jaw portion toward said upper jaw portion when said handle is turned to an operative position.

3. The spanner as claimed in claim 2, wherein said push portion projects from said connection end to said tail portion.

4. The spanner as claimed in claim 1, wherein said connection end of said handle has a front end face capable of abutting against said insert part of said lower jaw, said front end face having a beveled face proximate to said lower jaw.

5. The spanner as claimed in claim 1, wherein said pivot portion of said upper jaw has a lower end face facing said lower jaw, said lower jaw having a shoulder face proximate to said insert part and capable of abutting against said lower end face of said pivot portion of said upper jaw, said shoulder face being beveled.

6. The spanner as claimed in claim 1, wherein said tail portion of said lower jaw has a recess, said resilient member including a spring received in said recess, and a ball received in said recess and biased by said spring to move outward and contact said connection end of said handle.

7. The spanner as claimed in claim 1, wherein said upper jaw has a sloped guide edge adjacent to a front most end of said upper jaw portion.

* * * * *